US005811712A

United States Patent [19]

Held

[11] Patent Number: 5,811,712

[45] Date of Patent: Sep. 22, 1998

[54] PROTECTING DEVICE AGAINST PROJECTILES, PARTICULARLY HOLLOW CHARGE PROJECTILES

[75] Inventor: Manfred Held, Aresing, Germany

[73] Assignee: Daimler-Benz Aerospace AG, Munich, Germany

[21] Appl. No.: 641,988

[22] Filed: Dec. 17, 1975

[51] Int. Cl.[6] ..... F41H 5/007

[52] U.S. Cl. ..... 89/36.17; 89/36.02; 109/36

[58] Field of Search ..... 89/36 R, 36 A, 89/36.17, 36.02, 36.04, 36.08, 36.12; 109/36, 37, 49.5, 78, 80, 82, 84, 85; 428/911

[56] References Cited

U.S. PATENT DOCUMENTS 3,592,148 7/1971 Manis ..... 109/37

*Primary Examiner*—Charles T. Jordan
*Assistant Examiner*—Christopher K. Montgomery
*Attorney, Agent, or Firm*—McGlew and Tuttle

[57] ABSTRACT

A projective device especially useful against hollow charge projectiles is formed of a plurality of spaced apart layers inclined obliquely to the main firing direction of the projectiles. A centrally located combination layer consists of two disrupter layers sandwiching a reaction or explosive layer. On either side of the combination layer is a retardation layer. A movably displaceable layer is located on the opposite of one retardation layer from the combination layer and forms the outside surface of the device, while an immovable layer is on the opposite side of the other retardation layer from the combination layer and forms the inside surface of the device. When a hollow charge projectile impacts against the device, the hollow charge spike generated by the projectile is disrupted on its path through the device so that the effectiveness of the spike is seriously impeded.

12 Claims, 1 Drawing Sheet

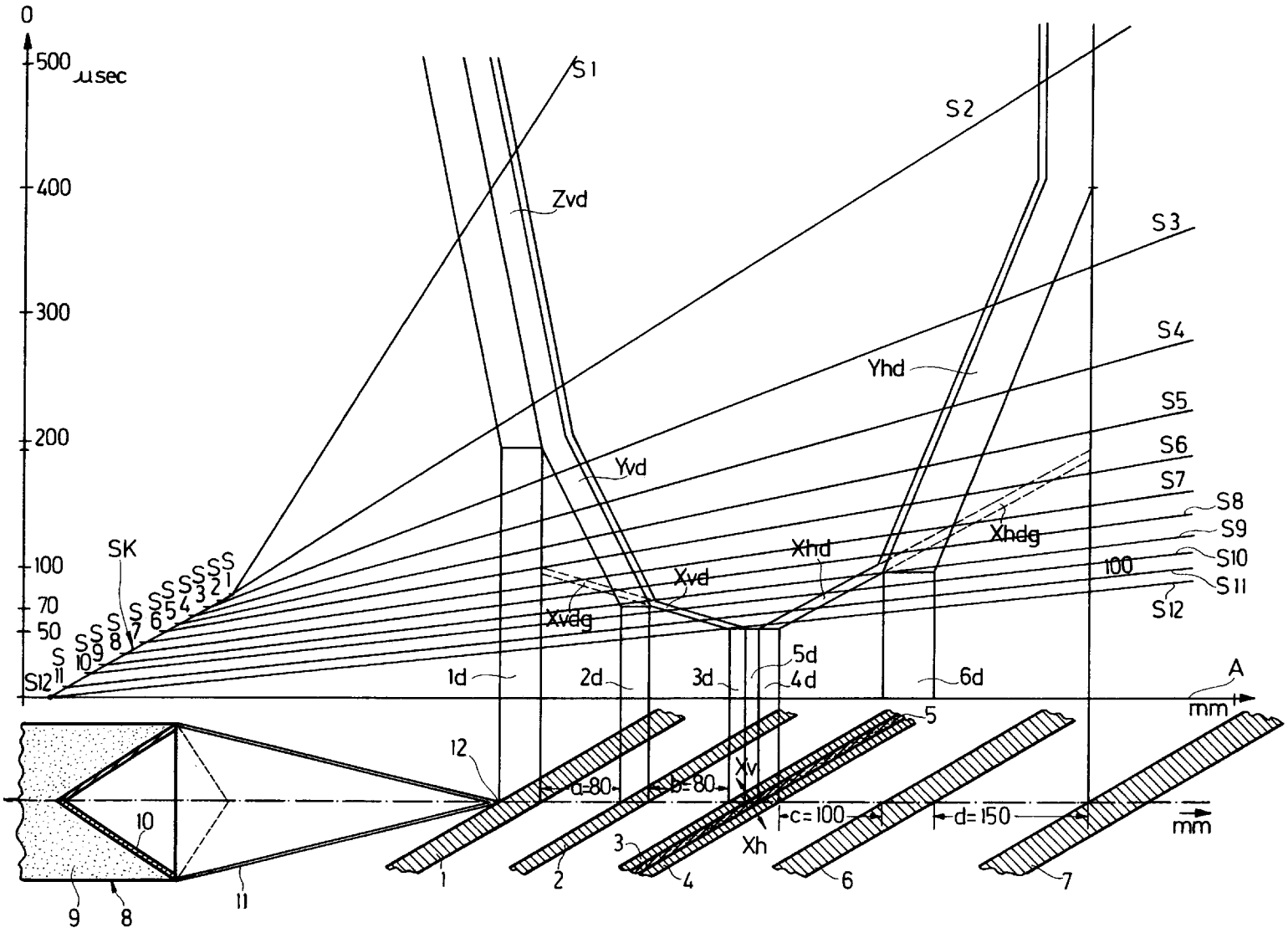
S1
S2
S3
S4
S5
S6
S7
S8
S9
S10
S11
S12
SK
Zvd
Yvd
Yhd
Xvd
Xvdg
Xhd
Xhdg
Xv
Xh
1d
2d
3d
4d
5d
6d
A
mm
100
70
50
0
500
400
300
200
μsec
a=80
b=80
c=100
d=150
1
2
3
4
5
6
7
8
9
10
11
12

PROTECTING DEVICE AGAINST PROJECTILES, PARTICULARLY HOLLOW CHARGE PROJECTILES

The invention relates to a protective device against projectiles, particularly hollow-charge projectiles, which consists of a number of separate layers and combinations of layers, which succeed one another at certain distances apart, and which, in particular, are situated obliquely in respect of the main direction of firing, and which include disruptor layers and reaction layers, the latter being, in particular, layers of explosive, which accelerate the disruptor layers, which then enter the traject of the projectile or of the barbs, with a disruptive effect.

Hollow-charge projectiles, by the detonation of their explosive charge, in conjunction with the lining present in the loading funnel, generate a spike of extremely high energy. This is capable of piercing very strong steel plating of a thickness 4 to 10 times the calibre of the projectile. This high penetrating power of the spike is due to its continuous elongated shape at a short distance or the succession of its particles at a greater distance between charge and target, with the longer period of action at the latter, as well as to its extremely high peak speeds, ranging up to 12,000 m/sec. For these factors cause such considerable and continuing pressure heads in the material of the target that the said material, no matter what its strength properties, is displaced along the axis of the spike, a slender elongated perforation being formed.

Many measures have already been developed and adopted by way of protection against the hollow charges, which represent a highly effective weapon. The most obvious way of strengthening the armourimg rapidly reaches its limit where its constructional weight, which is considerably increased, becomes unacceptable. With marine vessels likewise, of which the weight does not play such a great part as in the case of land vehicles and, in particular, in the case of aircraft, the armouring cannot be reinforced at the same rate as the penetrating power of high-calibre hollow charges increases.

The policy of repeatedly strengthening the armouring is thus being continually abandoned in favour of measures designed to reduce the weight and thickness of the armouring and at the same time to increase its resistance to penetration. Known protective devices consist of multi-layer walls, the separate layers being made of different materials. The aim and purpose of this particular construction for the wall is to hold up the hollow charge spike in the material by dispersing its penetrative action.

To combat structurally complex protective devices of this special type, use is nowadays made of slender weight projectiles of high material density and considerable hardness, which simply penetrate the said protective structures with their kinetic energy, thanks to very high flight velocities.

As a protection against weight projectiles of this kind, armouring systems are nowadays being developed in which, with multi-layer protective devices, some of which have a number of walls, layers or combinations of layers, situated at certain distances apart, disruptor walls with reaction layers, such as layers of explosive, are installed, in order to obtain a splitting-off effect, directly or indirectly initiated by the projectile making impact, the subsequent reaction or detonation flinging adjacent inert disruptor layers into the traject of the projectile entering or passing through.

In such protective devices the destruction of a hollow charge spike takes place in such a way that the spike is chopped up over large portions of its length, the individual particles of the spike being additionally diverted. The spike, of which the penetrative capacity in a homogeneous wall of steel is otherwise too high, then loses its boring power and remains in a divergent crater in armour plating following disruptor walls of this kind. Even as a defense against the aforementioned weight projectiles, disruptor walls of this kind are very effective, particularly in the case of layers of explosive, the reason being that the weight projectiles are deflected in their path, owing to the inert parts of the wall which are flung away with high kinetic energy by the layer of explosive in the process of detonation. The centre of gravity of the weight projectiles is thus tilted out of their traject and to some extent makes impact transversally on a subsequent armour plate, so that a great part of the projectiles intrinsic kinetic energy is wasted in the direction of penetration.

Military history provides many examples of the never-ending struggle between weapons of attack and the corresponding defensive measures. Although the structurally complex protective devices already mentioned, with a number of layers distances apart provide a large measure of immunity to adequate hollow charge weapons, the defensive equipment hitherto proposed nevertheless provides no complete protection against hollow charges of extreme specific power. Hollow charges of this kind, with explosive charges of maximum power density and power quality, due to the homogeneity and freedom from cracking of the explosive charge, and with accurate loading funnel fillings, as well as with optimum definition of the distance of the detonation from the target, produce an extremely elongated hollow charge spike with a high velocity gradient, the peak reaching a maximum speed of up to 12 km/sec, while the end of the spike only has a follow-up speed of about 500 m/sec. To disrupt a spike of this kind effectively, the distance between the disruptor layers, which are flung away by the detonation of the layer of explosive exploded by the peak of the spike, and the nearest protective walls has to be great enough to ensure that the flying time of the disruptor layers corresponds to the time taken by the total spike to pass through the gaps between the aforementioned layers. Owing to the elongated spike of the hollow charge, with the relatively long time of passage, due to the comparatively low velocity of the residual spike by comparison with the high velocity of its peak, and the still high minimum speed required for the disruptor layers, to ensure a disruptive effect that will still be effective, the walls would have to be made of a thickness no longer acceptable constructionally, particularly for mobile objects to be protected. Even if it proves possible, by means of protective devices with a large number of disruptor chambers situated in succession to one another, and at the price of an unaccustomed depth for the total wall, to utilize the various velocity ranges of a long hollow charge spike (which naturally succeed one another progressively) for disruption purposes, even special protective devices of this kind are no longer fully effective in the case of combined hollow charges with defined detonation intervals, i.e. distances adapted to the structure of the protective device, between a preliminary hollow charge for exploding the detonation layers serving for the acceleration of the disruptor layers and a subsequent penetrative charge. For the latter will not take effect on the protective device until the disruptor layers preceding the front protective wall have already been removed or are once again at rest within the said wall.

The purpose of the invention is to provide, even against hollow charge projectiles of high specific penetrative power, a highly efficient protective device which will provide the optimum defense against the phenomenon of an elongated spike with a high velocity gradient or of a preliminary advance disruptor spike and a follow-up penetrative spike succeeding it at a defined interval or of some other follow-up projectile, such as a weight projectile.

The invention enables this problem to be solved by braking, after a certain flying time, the disruptor layer or layers that have been flung off, in particular by one or more retardation layers it each case, succeeding one another at certain distances towards both sides as viewed in the direction of the projectile.

The term "certain flying time" is to be defined as the period in which the front spike range is combated. The military effect of the invention resides quite generally in the efficient disruption and destruction of even elongated hollow charge spikes with a very high energy content and with a high velocity gradient, by the intervention of moving parts of the layer or wall in the total length of the spike, in which process the retardation layers accompanying the movement also perform the function of additional disruptor layers. An equivalent effect to that obtained against hollow charge spikes is also obtained against other projectiles, such as weight projectiles, particularly rod-shaped weight projectiles.

Further specific characteristics of the invention are an intensity of the explosive layer or layers, a mass of the disruptor layers, free distances of the retardation layers from the disruptor layers on the one hand and from the subsequent layers or walls on the other, and a mass of the retardation layers, which are such that the front rapid spike zone is still reached by the disruptor layers and the remaining spike zone by the retardation layers and the disruptor layers together, in the moving state.

The invention is further characterized by a movable front layer or front wall, which together with a disruptor layer and retardation layer, in the moving state, intervenes in the residual spike zone.

A protective device constructed according to the invention consists of a movable front wall, of a front retardation layer following up at a free distance, a layer combination following up at a free distance and having a front disruptor layer, a rear disruptor layer and an explosive layer provided between them, of a rear retardation layer following up this layer combination at a distance, and of an immovable inner wall.

As a further development of the invention, the retardation layers may consist of an elastic material, such as spring steel. This provides a more elastic joint between the disruptor layer and the retardation layer, so that spike disruption is effected by a retardation layer continuing to move in the original direction of the disruptor layer and by the disruptor layer moving back in the reverse direction.

Another possible means of braking disruptor layers on their traject or in their movement to the next movable or fixed wall (in place of the retardation layers), and particularly of imparting progressive velocity characteristics to these layers, is to provide layers or bodies, e.g. of rubber, which are compressible or elastic, in front of these layers, as viewed in the direction of motion. This measure can also be adopted in front of the retardation layers, i.e. in conjunction with retardation layers likewise. The retardation layer can include a plastic material, such as lead or copper. While the side of the retardation layer facing toward the disruptor layer can be formed of plastic the opposite side can be formed of a hard material, such as armour steel.

The invention makes it possible for hollow charge spikes of extremely high specific power to be effectively combated with constructional means and without exceeding acceptable dimensions in the protective device. For the invention ensures a "kinetic-constructional adaptation" of the protective device to the speed characteristics of the entire hollow charge spike or to the times which it takes to pass through the individual wall zones, i.e. the measur proposed makes it possible to control the flight velocities or the duration of the action of the disruptor layers and of the retardation plates and thus of the whole of the qualified repeated intervention in the flight trajectory of the spikes.

The drawing shows an example of a protective device constructed in accordance with the invention, indicating its function in the form of a trajectory graph explained in greater detail in the following description.

The protective device shown consists of a front wall 1, movable within certain limits, of a front retardation layer 2 following it at a free distance a=80 mm, of a layer combination which follows it at a free distance b=80 mm and which has a front disruptor layer 3, a rear disruptor layer 4 and a layer of explosive 5 provided between the said two layers, of a rear retardation layer 6 following the said combination of layers 3,4 and 5 at a free distance c=100 mm, and finally of an immovable inner wall 7 following them at a free distance d=150 mm. All the protective walls or protective layers 1–7 are inclined at an angle of 60° in respect of the line perpendicular to the direction of firing or to the flight path of the hollow charge spike.

In the trajectory graph the distance through the protective device is shown in mm on the abscissa A, to a scale of 1:5. The free distance a–d between walls or layers and the paths through the layers, i.e. the passages 1*d*,2*d*,3*d*,4*d*,5*d*,6*d*,7*d*, these having, with the angle of inclination stated, twice the thickness of the wall or layer concerned, are shown on the abscissa A. The passages 1*d*–7*d* continue vertically upwards into the trajectory graph. The ordinate 0 forms the time axis. The time in μsec is given along this ordinate.

In front of the protective device a hollow charge 8 is shown, with an explosive charge 9, a lining 10 for the explosive hollow charge funnel and a conical projectile cap 11 at the tip of which is provide a percussion fuse 12 which makes straight impact on the front wall 1 and sets up the detonation of the hollow charge 8 at the rear end of the explosive charge 9 in the usual manner. The production of the hollow charge spike of extremely high energy, by detonative conversion of the explosive charge and the action of the detonation power on the lining, leading to the collapse phenomenon, is already known. In the trajectory graph of the diagram provided the spike which is in status nascendi as a result of the collapse process is shown as the "collapse line" SK. In the drawing it is subdivided, for example, into twelve parts, these being source points of parts S12 to S1 of the spike, the part S12 of the spike having the highest flight velocity of about 12 mm per μsec, that of the slowest part, i.e. S1, being about 1 mm/μsec.

The point of the spike, or part 12, penetrates the front wall 1, the retardation layer 2 and the layer combination 3,4,5, losing energy, speed and mass in the process, the explosive layer 5 having already been detonated before, either directly or indirectly, by part 12 of the spike. It may be assumed that the point or part 12 of the spike has been consumed in the retardation layer 6 or in the inner wall 7 at the latest. By the detonation of the explosive layer 5 the front disruptor layer 3 is accelerated in the direction shown by the arrow Xv and the rear disruptor layer 4 in that shown by the arrow Xh in such a way that the front disruptor layer 3 by reason of its mass attains a vertical flight velocity of about 2 km/sec or a cutting speed of 4 mm/μsec in the axis of the projectile, while the rear disruptor layer 4 by reason of its greater mass attains a vertical flight velocity of 1.0 km/sec or a cutting speed of 2 mm/μsec it the axis of the projectile or spike. With a free distance, b, of 80 mm, along the the axis of the projectile, between the front disruptor layer 3 and the front retardation layer 2, this means a flight time of 20 μsec for the front disruptor layer 3. Similarly, with a free distance, c, of 100 mm between the rear disruptor layer 4 and the rear retardation layer 6, along the axis of the projectile, the flight time for the rear disruptor layer 6 is 50 μsec. In the trajectory graph of the diagram the "intervention distances" are marked Xvd and Xhd. It is assumed that the detonation of the explosive layer 5 takes place at such a moment that the disruptor layers 3 and 4 are set in motion 50 μsec after the start of part S12 of the spike. From the intervention distances Xvd and Xhd it can be seen that zones or portions of the spike are repeatedly combated by the disruptor layers 3 and 4 during the flight time of these latter. These are the parts S12 to S10, which are dealt with by the front disruptor layer 3, and the parts S12 to S9, which are dealt with by the rear disruptor layer 4. If the retardation layers 2 and 6 were not present, then the front disruptor layer 3 would continue to fly with approximately a constant cutting speed of 4 mm/μsec in the axis of the projectile as far as the front wall 1 and the rear disruptor layer 4 at approximately constant cutting speed of 2 mm/μsec in the projectile axis as far as the inner wall 7. This movement is shown in the trajectory graph, from the retardation layers 2 and 6 onwards, by broken lines, i.e. assumed "trajectory intervention distances" Xvdg and Xhdg, i.e. the front disruptor layer 3 would only chop up the parts S8 and S7 of the spike, the rear disruptor layer 4 only chopping up the parts S8 to S6 of the spike. By braking the speeds of the disruptor layers 2 and 6, owing to the retardation layers 2 and 6 being caused to accompany the movement, it is possibly to intervene repeatedly in further parts of the spike. In this process the parts S6 to S3 of the spike likewise are dealt with by the front pair of layers 2 and 3 (totalling S9 to S3) and parts S5 to S3 of the spike likewise are dealt with by the rear pair of layers 4 and 6 (totalling S8 to S3), as shown by the "intervention distances" Yvd and Yhd.

The front wall 1 being mounted movably, repeated intervention in the remaining part of the hollow charge spike or in the parts S2 and S1 is likewise effected as a result of the fact that the front wall 1 is forced, by the pair of layers 2 and 3 making impact thereon, to accompany their forward movement. In this case the "intervention distance" is marked Zvd.

As shown by the present example, the invention makes it possible for the following charge spike, over its entire length, and despite its considerable velocity gradient, to be combated by moving walls and layers, so that by introducing material over a cutting (oblique) path into the traject of the spike the latter is completely disrupted and finally destroyed, or deprived of its boring action. Equivalent considerations apply to solid projectiles of various kinds of which the flight path is disrupted, as mentioned at the beginning.

It is also pointed out that the intervention into the front parts of the spike, which are moving at the maximum speeds and thus have a high energy content, by the disruptor layers 3 and 4, which the invention enables to move at a high speed in this zone, can be effected with the introduction of a considerable amount of material into the trajectory of the projectile, i.e. a relatively long period of intervention is obtained without the necessity of subsequently reducing the intensity with which the subsequent parts of the spike are combated.

I claim:

1. Protective device against projectiles, comprising a number of layers spaced apart from one another, said layers disposed obliquely in respect to the main firing direction of a projectile directed at the protective device, said layers including at least one combination layer comprising a pair of disruptor layers with a reaction layer sandwiched between said disruptor layers, one of said disruptor layers having a free surface facing away from said reaction layer and facing in the opposite direction to the main firing direction of a projectile and the other of said disruptor layers having a free surface facing away from said reaction layer and facing in the direction of the main firing direction of a projectile, said reaction layer including an explosive, at least one retardation layer spaced from each free surface of said disruptor layers of said combination layer so that when the explosive in said reaction layer is ignited it displaces said disruptor layers toward the adjacent ones of said retardation layers which retardation layers effect a braking action on said disruptor layers.

2. Protective device, as set forth in claim 1, wherein said layers include a front wall layer defining the outermost surface of said device which is first contacted by a projectile and a rear wall layer defining the innermost surface of said device, one of said retardation layers spaced between said front wall layer and said combination layer and the other said retardation layer spaced between said rear wall layer and said combination layer.

3. Protective device, as set forth in claim 2, wherein said front wall layer being flexibly displaceable upon the reaction generated by said disruptor layer contacting said retardation layer when said reaction layer is ignited.

4. Protective device, as set forth in claim 2, wherein said front wall layer is flexibly displaceable and said rear wall layer is immovable.

5. Protective device, as set forth in claim 2, wherein said retardation layers include an elastic material.

6. Protective device, as set forth in claim 5, wherein said elastic material comprises a spring steel.

7. Protective device as set forth in claim 2, wherein said retardation layers include a plastic material.

8. Protective device as set forth in claim 7, wherein said plastic material is lead.

9. Protective device, as set forth in claim 7, wherein said plastic material is copper.

10. Protective device, as set forth in claim 2, wherein said retardation layers include a sublayer of plastic material facing toward the adjacent said disruptor layer and a sublayer of a hard material facing in the opposite direction.

11. Protective device, as set forth in claim 10, wherein said hard material is an armour steel.

12. Protective device, as set forth in claim 2, wherein elastic material is located between at least one of the front wall layer and the adjacent retardation layer, said retardation layer and the adjacent disruptor layer and said rear wall layer and the adjacent said retardation layer.

* * * * *